US009644635B2

(12) United States Patent
Mizukami et al.

(10) Patent No.: US 9,644,635 B2
(45) Date of Patent: May 9, 2017

(54) ELECTRIC AIR BLOWER

(71) Applicant: PANASONIC CORPORATION, Kadoma-shi, Osaka (JP)

(72) Inventors: Hirofumi Mizukami, Osaka (JP); Tetsuo Shimasaki, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 326 days.

(21) Appl. No.: 14/373,559

(22) PCT Filed: Mar. 4, 2013

(86) PCT No.: PCT/JP2013/001286
§ 371 (c)(1),
(2) Date: Jul. 21, 2014

(87) PCT Pub. No.: WO2013/140723
PCT Pub. Date: Sep. 26, 2013

(65) Prior Publication Data

US 2014/0369870 A1 Dec. 18, 2014

(30) Foreign Application Priority Data

Mar. 21, 2012 (JP) ..... 2012-063016

(51) Int. Cl.
*F04D 29/00* (2006.01)
*F04D 29/08* (2006.01)
(Continued)

(52) U.S. Cl.
CPC ..... *F04D 29/083* (2013.01); *F04D 29/162* (2013.01); *F04D 29/403* (2013.01);
(Continued)

(58) Field of Classification Search
CPC .. F04D 29/403; F04D 29/162; F04D 29/4213; F04D 29/601; F04D 29/626
(Continued)

(56) References Cited

U.S. PATENT DOCUMENTS 1,525,884 A * 2/1925 Plummer ..... F04D 29/167 415/112
4,718,805 A 1/1988 Becker
(Continued)

FOREIGN PATENT DOCUMENTS

AU 2007236557 10/2007
CA 2056483 4/1992
(Continued)

OTHER PUBLICATIONS

English Translation of Chinese Search Report dated Feb. 1, 2016 for the related Chinese Patent Application No. 201380015094.3, 3 pages.
(Continued)

*Primary Examiner* — Charles Freay
*Assistant Examiner* — Christopher Bobish
(74) *Attorney, Agent, or Firm* — Hamre, Schumann, Mueller & Larson, P.C.

(57) ABSTRACT

Fan (3) includes suction-side shroud (3*a*) and suction port (22) at the center portion of suction-side shroud (3*a*). Fan case (2) includes opening part (13) at a location facing suction port (22). Fan seal (4) is disposed between inner wall surface (2*a*) of fan case (2) and suction port-side end surface (3*b*) of suction-side shroud (3*a*). Opening part (13) includes a plurality of mushroom-shaped anchors (2*b*). Fan seal (4) includes holding parts (4*b*) that fit onto mushroom-shaped anchors (2*b*). Fan seal (4) is press-fitted onto fan case (2) that includes mushroom-shaped anchors (2*b*).

12 Claims, 13 Drawing Sheets

(51) Int. Cl.

| | |
|---|---|
| ***F04D 29/16*** | (2006.01) |
| ***F04D 29/40*** | (2006.01) |
| ***F04D 29/60*** | (2006.01) |
| ***F04D 29/42*** | (2006.01) |
| ***F04D 29/62*** | (2006.01) |
| *F04D 25/06* | (2006.01) |
| *F04D 17/16* | (2006.01) |

(52) U.S. Cl.
CPC ..... *F04D 29/4213* (2013.01); *F04D 29/601* (2013.01); *F04D 29/626* (2013.01); *F04D 17/16* (2013.01); *F04D 25/06* (2013.01)

(58) Field of Classification Search
USPC ..... 417/423.1, 423.14, 424.1
See application file for complete search history.

(56) References Cited

U.S. PATENT DOCUMENTS

| | | | | |
|---|---|---|---|---|
| 4,767,285 | A * | 8/1988 | Jyoraku | F04D 25/06 415/119 |
| 5,110,266 | A * | 5/1992 | Toyoshima | A47L 5/22 415/119 |
| 5,183,366 | A | 2/1993 | Peach | |
| 5,954,476 | A * | 9/1999 | Stewart | F04D 29/083 403/334 |
| 6,439,843 | B1 * | 8/2002 | Finkenbinder | F04D 29/162 415/172.1 |
| 6,527,509 | B2 * | 3/2003 | Kurokawa | F01D 5/145 415/173.1 |
| 6,695,580 | B2 * | 2/2004 | Finkenbinder | F04D 29/162 415/208.3 |
| 7,244,099 | B2 * | 7/2007 | Yamasaki | F04D 29/162 415/173.6 |
| 7,281,908 | B2 * | 10/2007 | Fujita | A47L 5/22 310/59 |
| 8,317,496 | B2 * | 11/2012 | Finkenbinder | F04B 17/00 415/199.3 |
| 2005/0269133 | A1 | 12/2005 | Little | |
| 2009/0297326 | A1 | 12/2009 | Davidson | |

FOREIGN PATENT DOCUMENTS

| | | |
|---|---|---|
| CN | 101179217 | 5/2008 |
| CN | 201925193 U | 8/2011 |
| CN | 102242723 | 11/2011 |
| EP | 1045177 | 10/2000 |
| JP | 6-323297 | 11/1994 |
| JP | 8-326698 | 12/1996 |
| JP | 9-079189 | 3/1997 |
| JP | 9-317693 | 12/1997 |
| JP | 11-201093 | 7/1999 |
| JP | 2000-297774 | 10/2000 |
| JP | 2000-303991 | 10/2000 |
| JP | 2003-083291 | 3/2003 |
| JP | 2007-040110 | 2/2007 |
| JP | 2011-247098 | 12/2011 |
| WO | 98/55728 | 12/1998 |
| WO | 00/65193 | 11/2000 |
| WO | 2007/115375 | 10/2007 |
| WO | 2010/141585 | 12/2010 |

OTHER PUBLICATIONS

The Extended European Search Report dated Feb. 10, 2015; European Patent Application No. 13764541.2 (4 pages).

* cited by examiner

ELECTRIC AIR BLOWER

TECHNICAL FIELD

The present invention relates to electric blowers for use in electric devices such as electric cleaners and hand dryers.

BACKGROUND ART

In recent years, progress in power saving for electric devices has been achieved. With this progress, electric blowers used in the electric devices are required to have higher output power and higher efficiency. In particular, an electric vacuum cleaner, i.e. an electric device, is required to exhibit higher suction power.

Hereinafter, referring to FIG. 14, descriptions will be made regarding a conventional electric blower. The electric blower includes a motor and a fan unit integrally in one unit. The fan unit is airtightly attached to the motor, i.e. hermeticity being held between them. The fan unit is composed of air guide 101, fan case 102, fan 103, and fan case spacer 104. Fan 103 includes suction-side shroud 103*a*. Fan 103 includes suction port 122 in a center portion of suction-side shroud 103*a*.

FIG. 15 is an enlarged cross-sectional view of Z portion shown in FIG. 14. Suction port-side end surface 103*b* of suction-side shroud 103*a* that fan 103 includes, is in contact with the outer-peripheral side surface of bellows 104*a* that fan case spacer 104 includes. Alternatively, suction port-side end surface 103*b* of suction-side shroud 103*a* has a very slight clearance of about 0.1 mm or less with the outer-peripheral side surface of bellows 104*a*. This configuration secures the airtightness, i.e. the hermeticity, between suction-side shroud 103*a* and fan case spacer 104.

Moreover, fan case spacer 104 is fixed to fan case 102 so as to secure the airtightness with fan case 102. Fan case spacer 104 is fixed to fan case 102, by welding or bonding. In Patent Literature 1, a technology associated with the conventional electric blower is described.

By the way, the conventional electric blower has had the following problems to be solved.

The first one is dimensional accuracy of bellows 104*a* included in fan case spacer 104. In particular, bellows 104*a* facing suction-side shroud 103*a* has a profile which is difficult to ensure a stable dimensional accuracy of its outer-peripheral side surface.

The second one is poor concentricity between fan case spacer 104 including bellows 104*a* and fan 103 including suction-side shroud 103*a*, i.e. a low degree of their positioning accuracy with respective to their common axis. This is because fan case spacer 104 is welded to fan case 102 or, alternatively, is bonded and fixed to fan case 102. As a result, the concentricity becomes poorer between the outer-peripheral side surface of bellows 104*a* and suction port-side end surface 103*b* of suction-side shroud 103*a*.

The third one lies in circularity of bellows 104*a*. That is, when the electric blower is operated, the motor section thereof generates heat. When fan case 102 is made of metal, the generated heat is conducted to fan case spacer 104 via fan case 102, i.e., the metal material. The thus-conducted heat raises the temperature of fan case spacer 104. Temperature-raised fan case spacer 104 sometimes deforms due to its thermal expansion. Such deformation of fan case spacer 104 can deteriorate the circularity of bellows 104*a* that forms a part of fan case spacer 104.

The thus-deteriorated dimensional accuracy, such as the poor concentricity and the poor circularity, results in insufficient airtightness between suction port-side end surface 103*b* of suction-side shroud 103*a* included in fan 103 and the outer-peripheral side surface of bellows 104*a* included fan case spacer 104. The insufficient airtightness sometimes causes a reverse flow of air discharged from the outer periphery of fan 103, through a gap between fan case 102 and an upper portion of suction-side shroud 103*a* included in fan 103. Such a reverse-flow phenomenon leads to an air-leakage into a suction-port portion of fan 103, i.e. suction port 122. As a result, this interferes with the drop in vacuum pressure at the suction-port portion of fan 103, resulting in a decrease in the output of the electric blower. The decrease in the output leads to a reduction in the suction power in an electric cleaner.

Moreover, after fan case spacer 104 has been welded to fan case 102 or, alternatively, fan case spacer 104 has been bonded to fan case 102, fan case 102 is press-fitted into a bracket of the electric blower. In this way, fan case 102 is fixed to the bracket of the electric blower. Fan case 102 is press-fitted into the bracket, in a state that suction port-side end surface 103*b* of suction-side shroud 103*a* is in contact with the outer peripheral side surface of bellows 104*a* included in fan case spacer 104. This means that, when fan case 102 is press-fitted into the bracket, fan case spacer 104 is subjected to stress from the outer peripheral portion of suction port 122. Between fan case spacer 104 and fan case 102, the welding strength or bonding strength enough to accommodate the stress is necessary. In order to secure the necessary welding strength or bonding strength, an area commensurate with the welding strength or bonding strength is needed at which fan case spacer 104 and fan case 102 are welded or bonded to each other.

Accordingly, fan case spacer 104 is then very large in size. Fan case spacer 104 is formed as a molded article.

In addition, the process of welding or bonding fan case spacer 104 to fan case 102 is necessary. Consequently, the manufacturing of the conventional electric blower requires a lot of man-hours.

CITATION LIST

Patent Literature

Patent Literature 1: Japanese Patent Unexamined Publication No. H06-323297

SUMMARY OF THE INVENTION

An electric blower according to the present invention includes a field magnet, an armature, a pair of brushes, a fan, an air guide, a fan case, and a fan seal.

The field magnet is held by a bracket. The armature includes a pair of bearings at both ends of an armature shaft, and the armature is supported by the pair of the bearings. The pair of the brushes is disposed in the bracket. The fan is disposed on the output side of the armature shaft. The fan includes a suction-side shroud and a suction port at a center portion of the suction-side shroud. The air guide is disposed on the exhaust side of the fan. The fan case covers both the fan and the air guide. The fan case includes an opening part at a location facing the suction port. The fan seal is disposed between the inner wall surface of the fan case and the suction port-side end surface of the suction-side shroud. In the fan seal, an inner peripheral surface refers to a surface which faces the inner wall surface, while an outer peripheral surface refers to a surface which faces the suction port-side end surface. The opening part includes a plurality of mushroom-shaped anchors. The fan seal includes holding parts which fit onto the mushroom-shaped anchors.

The fan seal is press-fitted onto the fan case; the fan seal is fixed to the fan case.

DESCRIPTION OF EMBODIMENTS

Figure 1:
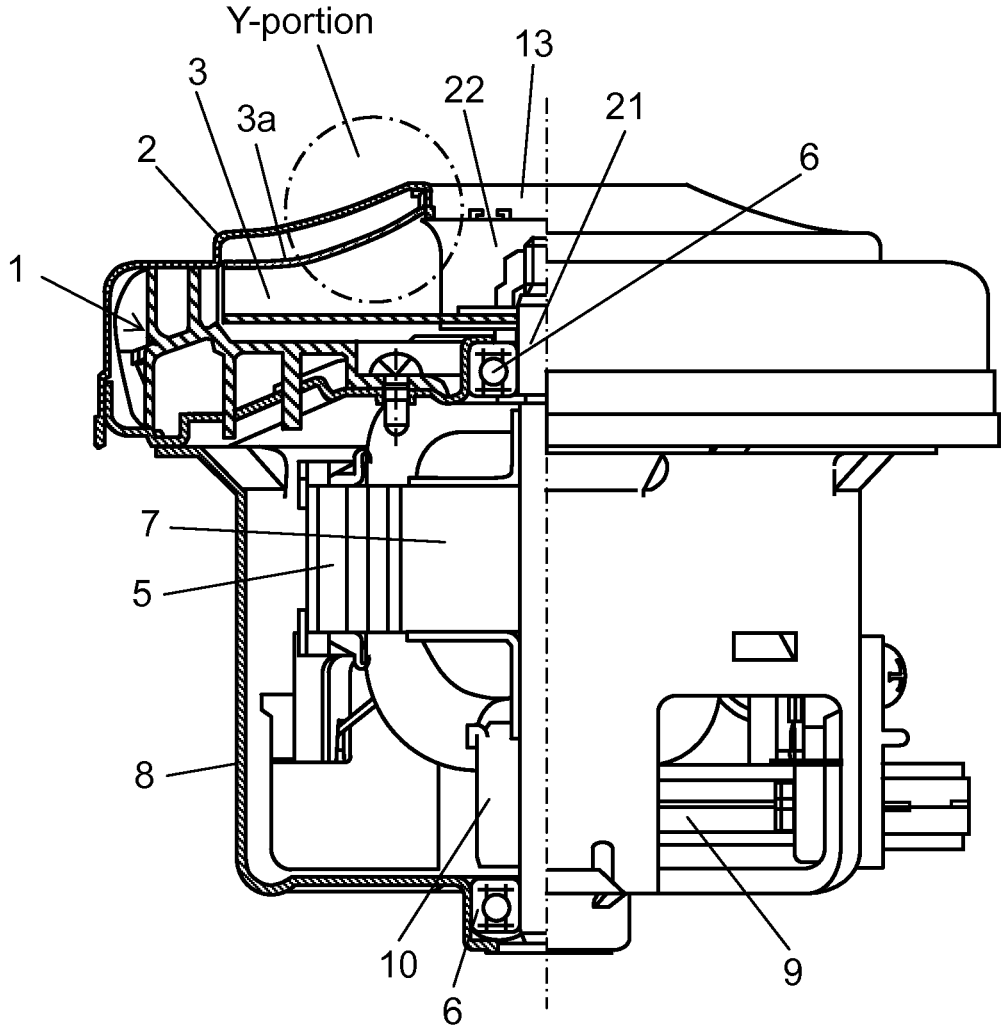
FIG. 1 is a partially-cutaway side-elevational view of an electric blower according to a first embodiment of the present invention.

An electric blower according to an embodiment of the present invention takes a configuration to be described later, which thereby solves the to-be-improved problems of conventional electric blowers.

It is noted that, in the following descriptions, the thrust direction is the axial direction of an armature shaft which rotates a fan. Along the axial direction, the fan includes a suction port to be described later. Moreover, on the axis, there is located the center of an opening part to be described later which is included in a fan case facing the suction port. A guide part which forms the opening part is extended along the axial direction.

Like this, the radial direction is a direction perpendicularly intersecting the thrust direction.

In addition, the mushroom-shaped anchor is a locking part having a predetermined width, which forms a flange-shaped wall of the fan case. The flange-shaped locking part has a projection part at the end portion thereof. The projection part protrudes toward both directions that perpendicularly intersect the direction in which the locking parts extend.

The electric blower according to the embodiment of the invention includes a field magnet, an armature, a pair of brushes, the fan, an air guide, the fan case, and a fan seal.

The field magnet is held by a bracket. The armature includes a pair of bearings at both ends of the armature shaft, with the armature being supported by the pair of the bearings. The pair of the brushes is disposed in the bracket. The fan is disposed on the output side of the armature shaft. The fan includes a suction-side shroud and a suction port at a center portion of the suction-side shroud. The air guide is disposed on the exhaust side of the fan. The fan case covers both the fan and the air guide. The fan case includes the opening part at a location facing the suction port. The fan seal is disposed between the inner wall surface of the fan case and the suction port-side end surface of the suction-side shroud. In the fan seal, an inner peripheral surface refers to a surface which faces the inner wall surface, while an outer peripheral surface refers to a surface which faces the suction port-side end surface. The opening part includes a plurality of the mushroom-shaped anchors. The fan seal includes holding parts which fit respectively onto the mushroom-shaped anchors.

In the configuration, the fan seal coincident in shape with the fan case is press-fitted onto the fan case that includes the mushroom-shaped anchors. At this time, the holding parts of the fan seal are press-fitted onto the mushroom-shaped anchors of the fan case. As a result, the mushroom-shaped anchors are fitted into the holding parts. In this way, the fan seal is fixed to the fan case.

This configuration, in which the fan seal is press-fitted onto the fan case, makes it possible to retain the strength of holding the fan seal by the fan case in the thrust direction.

Moreover, in the electric blower according to the embodiment of the present invention, the opening part includes a suction port-side opening end, an outer-side opening end, and the guide part.

The suction port-side opening end communicates with the suction port. The outer-side opening end communicates with the outside of the fan case. The guide part communicates between the suction port-side opening end and the outer-side opening end. The guide part includes the plurality of the mushroom-shaped anchors at the periphery of the suction port-side opening end, in the thrust direction in which the guide part extends.

With this configuration, it is possible to obtain the following actions and advantages, in addition to the aforementioned actions and advantages.

That is, because the fan seal is composed of an elastic material such as rubber or resin, the fan seal is capable of taking a profile which can fit in shape with the opening part of the fan case.

Specifically, the inner peripheral surface of the fan seal takes a profile which fits in shape with the outer periphery of the guide part, i.e. the inner wall surface of the fan case. The outer peripheral surface of the fan seal, i.e. the back side of the inner peripheral surface of the fan seal, also takes a profile which fits in shape with the inner wall surface of the fan case. As a result, the profile of the outer peripheral surface of the fan seal is stabilized; therefore, the outer peripheral surface becomes in contact with the suction port-side end surface of the suction-side shroud. Alternatively, the outer peripheral surface of the fan seal, which faces the suction port-side end surface of the suction-side shroud, is secured to have a stable dimensional accuracy in terms of concentricity, circularity, and the like.

Moreover, in the electric blower in the embodiment of the present invention, the holding parts may be formed in the following shape. That is, the holding parts each have a bump shape, on the inner peripheral surface, which is capable of holding the respective mushroom-shaped anchor.

In particular, the following dimensional relation will provide remarkable actions and effects. That is, let t1 be the dimension of protrusion of the bumps from the inner peripheral surface, i.e. the thickness of the bumps, and let t2 be the thickness of the guide part. This leads to the relation that t1 is larger than t2.

With this configuration, the bumps are formed on the inner peripheral surface of the fan seal, with the bumps having the thickness larger than that of the fan case, especially that of the wall configuring the guide part of the fan case. That is, each of the bumps is formed such that an end portion of the guide part protrudes from the inner wall surface side toward the shaft center side, in the radial direction.

Accordingly, the bumps are operative to retain the holding strength of the fan seal in the radial direction, when the fan seal is held by the fan case, especially by the guide part thereof.

Moreover, in the electric blower in the embodiment of the present invention, the holding parts may be formed in the following shape: That is, each of the holding parts includes a pair of the bumps. The holding part includes an inclined part, in between the bumps of the pair, the inner peripheral surface of which is inclined from the inner peripheral surface side toward the outer peripheral surface side. Each of the mushroom-shaped anchors is inclined along the respective inclined part.

That is, the end portion of the mushroom-shaped anchor is bent at the angle along the inclined part. The end portion of the mushroom-shaped anchor is expanded such that the fan case becomes in a state of being crimped and fixed to the fan seal.

This allows the fan seal to be held by the fan case, resulting in a further increased strength of the fan seal, in both the thrust direction and the radial direction.

With the configuration described above, in the electric blower according to the embodiment of the present invention, the fan seal is press-fitted along the inner wall surface of the fan case. The press-fitted fan seal is fixed to the fan case, which can secure the stable airtightness. This increases the output of the electric blower.

Moreover, in the electric blower according to the embodiment of the present invention, the seal member, i.e. the fan seal, can be made smaller in size. It is possible to adopt the simplified method of fixation in which the fan seal is press-fitted along the inner wall surface of the fan case. Consequently, the cheap sealing-configuration is available for the electric blower.

Hereinafter, the electric blowers according to the embodiments of the present invention will be described with reference to FIGS. 1 to 13. It should be noted, however, that the embodiments to be described below are nothing more than examples of implementation of the present invention and are in no way intended to limit the technical scope of the present invention.

First Exemplary Embodiment

Figure 2:
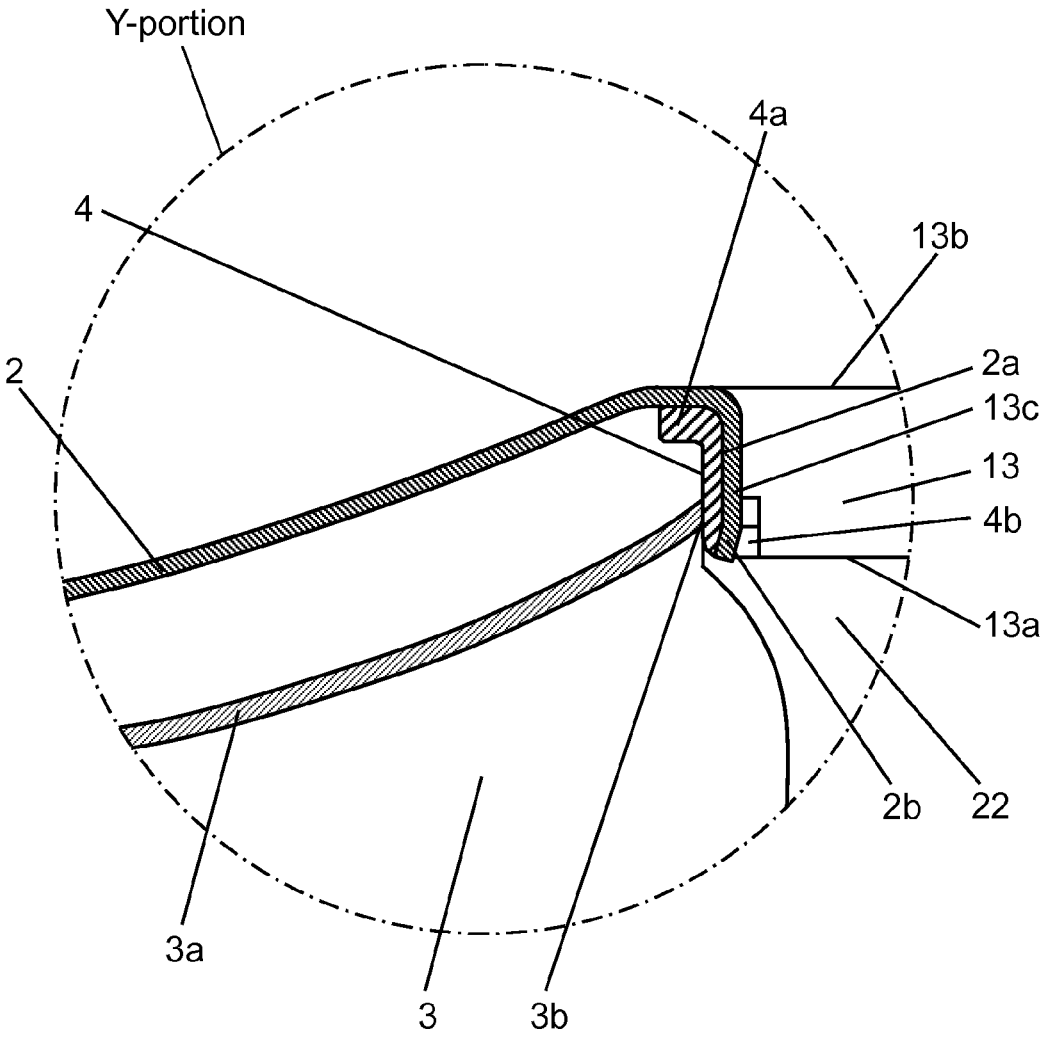
FIG. 2 is an enlarged view of a principal part of the electric blower.
Figure 3:
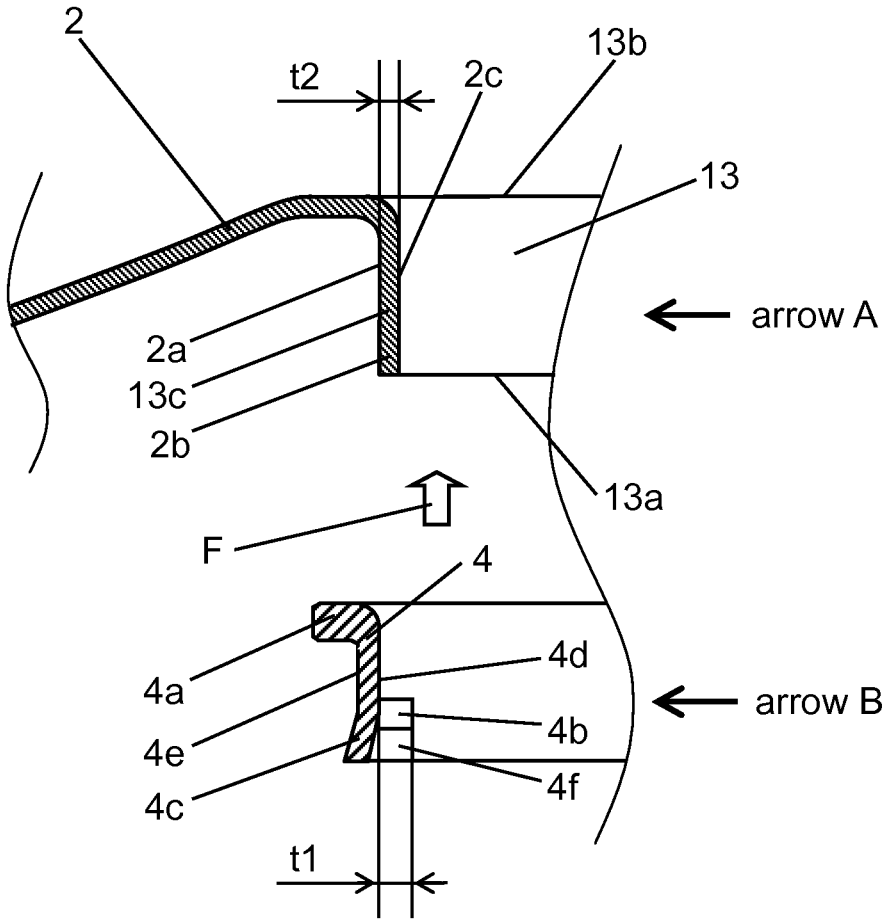
FIG. 3 is a view illustrating assembling of the principal part of the electric blower shown in FIG. 2.

FIG. 1 is a partially-cutaway side-elevational view of an electric blower according to an embodiment of the present invention. FIG. 2 is an enlarged view of a principal part of the electric blower. FIG. 3 is a view illustrating assembling of the principal part of the electric blower shown in FIG. 2.

As shown in FIG. 1, field magnet 5 is fixed to bracket 8. In a center portion of field magnet 5, armature 7 is disposed which is supported by a pair of bearings 6. To bracket 8, a pair of brushes 9 is attached. A control current is supplied, via the pair of brushes 9, to commutator 10 that armature 7 includes. Upon supplying the control current, armature 7 rotates. To the output side of armature shaft 21, fan 3 is attached in a state of being airtight, i.e. hermetic. When armature 7 rotates, fan 3 also rotates at high speed. Fan 3 includes suction port 22 in a center portion of the fan. Fan case 2 includes opening part 13 at a location facing suction port 22. When fan 3 rotates, air flows in from suction port 22 via opening part 13. The thus-flow-in air is discharged from an inlet part of fan 3 toward the outer peripheral direction. The thus-discharged air flows through air guide 1 into a motor unit.

Figure 14:
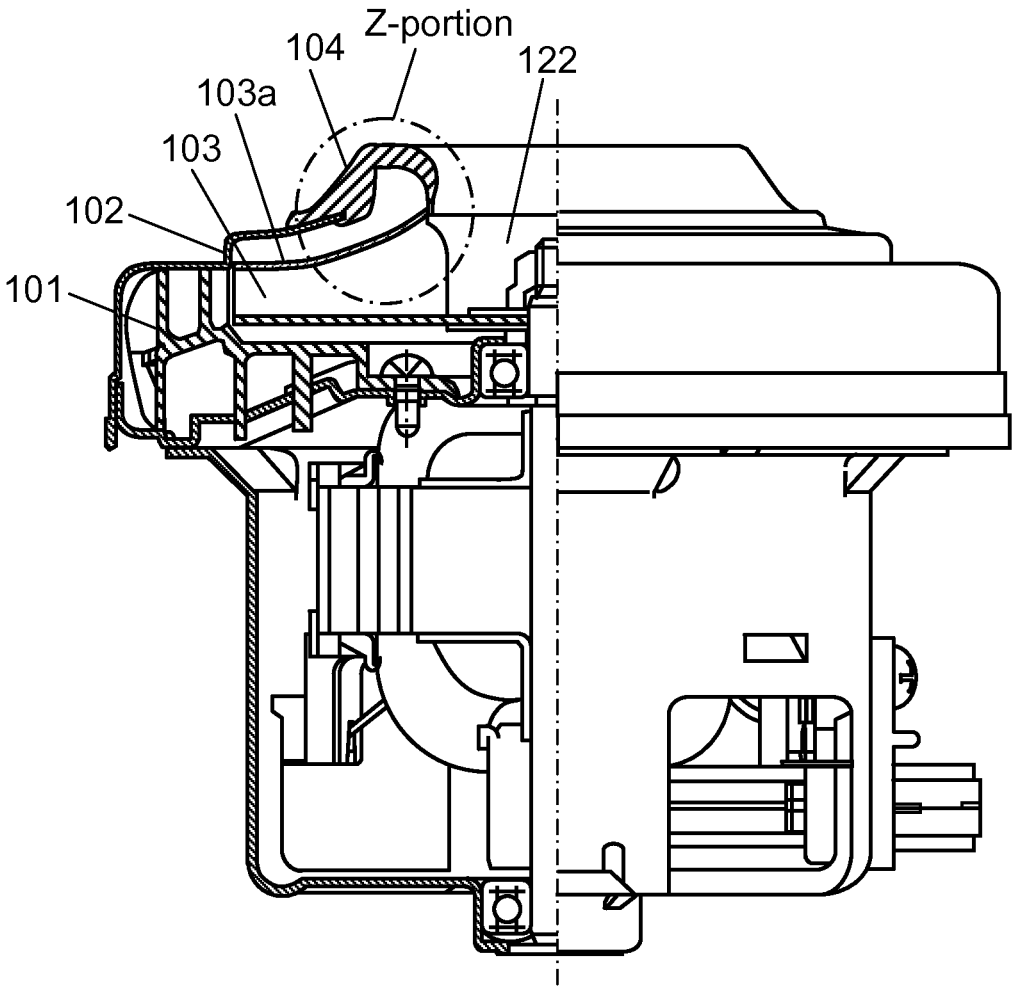
FIG. 14 is a partially-cutaway side-elevational view of a conventional electric blower.
Figure 15:
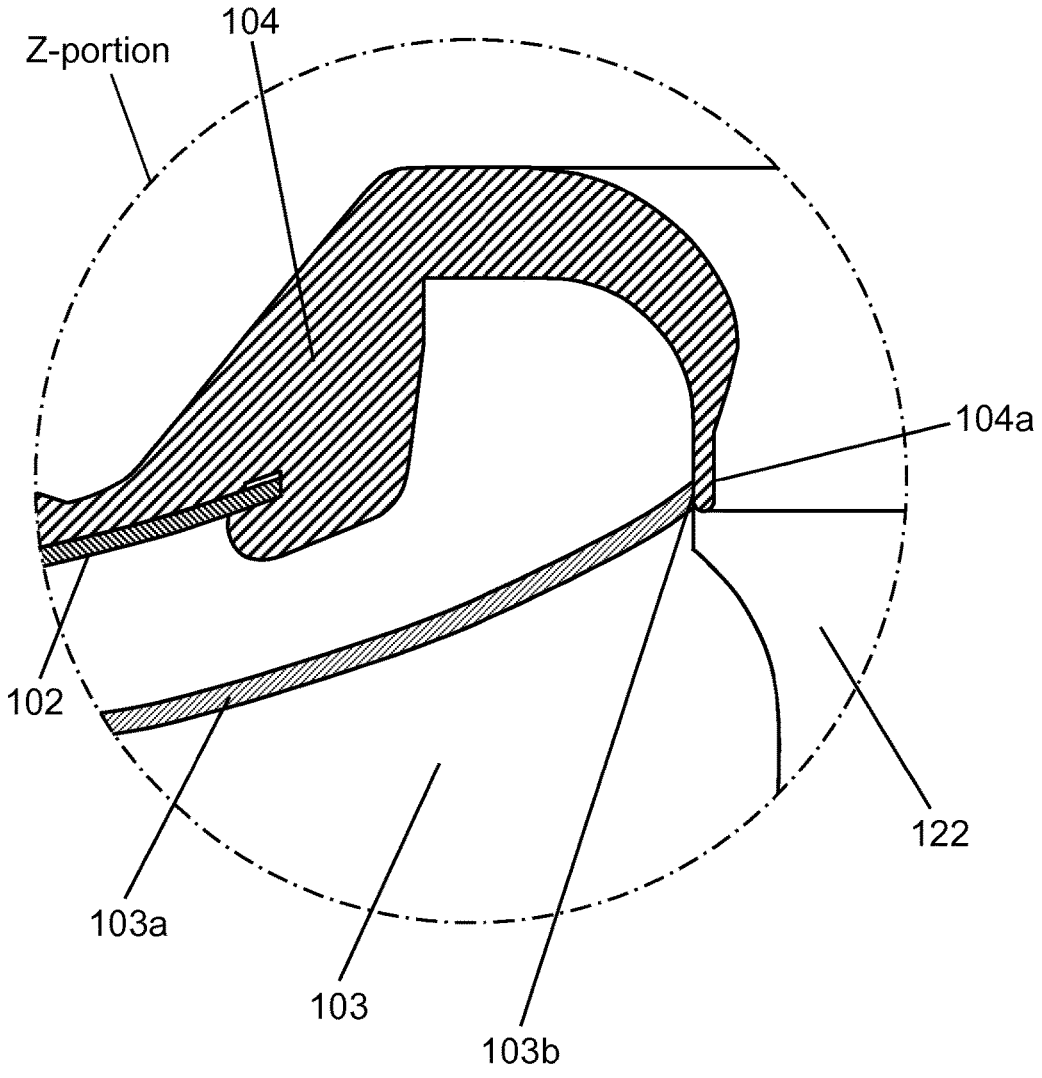
FIG. 15 is an enlarged view of a principal part of the conventional electric blower.

FIG. 2 is an enlarged view of Y portion shown in FIG. 1. Fan seal 4 is disposed between inner wall surface 2*a* of fan case 2 and suction port-side end surface 3*b* of suction-side shroud 3*a* that fan 3 includes. Fan seal 4 is aimed at keeping the airtightness, i.e. the hermeticity. Fan seal 4 is accommodated in the inside of fan case 2. As shown in FIGS. 14 and 15, a conventional electric blower is formed such that fan case spacer 104 to keep airtightness is disposed in the outside of fan case 102. When the electric blower according to the embodiment of the present invention is compared with this conventional electric blower, a difference from the conventional one will be found in that, fan seal 4 is formed in the inside of fan case 2 in the electric blower according to the embodiment of the invention. Therefore, the member to keep the airtightness is small in size relative to that in the conventional one. Moreover, the total height of the electric blower according to the embodiment of the invention is small relative to that of the conventional one. As a result, the electric blower according to the embodiment of the invention can be made compact in size as a whole.

Fan seal 4 includes outer-peripheral flat part 4*a* on the outer-side opening end 13*b* side of fan case 2. When fan seal 4 is press-fitted onto fan case 2, outer-peripheral flat part 4*a* is held by a press-fitting fixture. Outer-peripheral flat part 4*a* is applied with a load by the press-fitting fixture.

FIG. 3 is a view illustrating a state in which fan seal 4 is press-fitted onto fan case 2. In the Figure, arrow F indicates the direction in which fan seal 4 is press-fitted.

As shown in FIG. 3, fan case 2 includes opening part 13. Opening part 13 includes suction port-side opening end 13*a* on one side. Opening part 13 includes outer-side opening end 13*b* on the other side. Opening part 13 includes guide part 13*c* that communicates between suction port-side opening end 13*a* and outer-side opening end 13*b*. At the periphery of suction port-side opening end 13*a* of guide part 13*c*, mushroom-shaped anchors 2*b* are formed.

Moreover, on inner peripheral surface 4*d* of fan seal 4, bumps 4*f* serving as holding parts 4*b* are disposed. Bumps 4*f* serving as holding parts 4*b* are each configured to protrude from the inner wall surface 2*a* side of fan case 2 toward the inner-diametrical surface 2*c* side thereof.

This configuration is especially effective when the following dimensional relation is satisfied between bumps 4*f* and the thickness of the wall that forms guide part 13*c*. That is, let t1 be the dimension of protrusion of bumps 4*f* from inner peripheral surface 4*d*, i.e. the thickness of bumps 4*f*, and let t2 be the thickness of the guide part 13*c*. This leads to the relation that t1 is larger than t2.

With this configuration, bumps 4*f* are formed on inner peripheral surface 4*d* of fan seal 4, with the thickness of the bumps being larger than that of fan case 2, especially that of the wall configuring guide part 13*c*. That is, bumps 4*f* are configured such that the end portions of the bumps protrude away from guide part 13*c* in the radial direction, from the inner wall surface 2*a* side to the axial direction side in the radial direction.

This configuration allows a proof stress thereof against stresses in the radial direction which are caused during the rotation of fan 3.

In the fan-side end portions of fan seal 4, inclined parts 4*c* are disposed, inner peripheral surface 4*d* of each of which is inclined from the inner peripheral surface 4*d* side toward the outer peripheral surface 4*e* side. After fan seal 4 has been press-fitted onto fan case 2, the end portions of mushroom-shaped anchors 2*b* included in fan case 2 are bent respectively along inclined parts 4*c*. With this configuration, fan case 2 is crimped and fixed to fan seal 4, in both the thrust direction and the radial direction.

Figure 4:
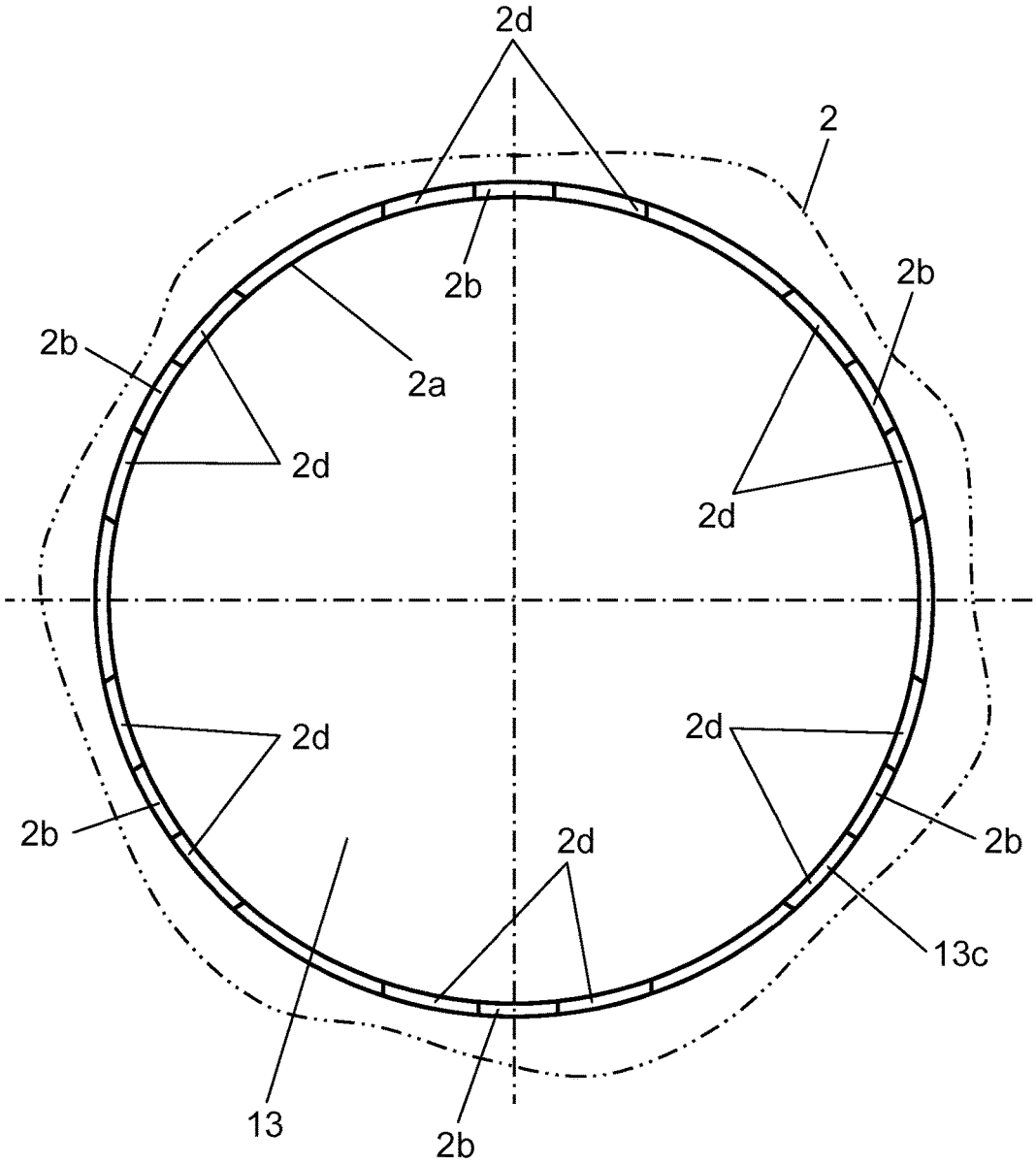
FIG. 4 is an elevational view of a principal part of a fan case which the electric blower includes.
Figure 5:
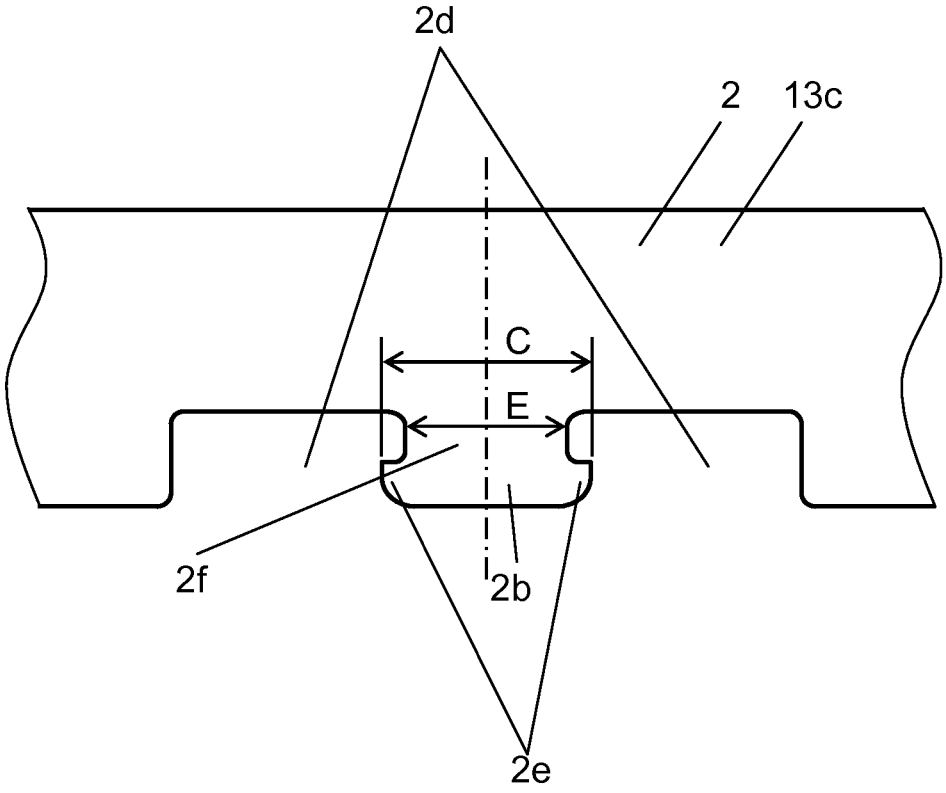
FIG. 5 is an enlarged view of a principal part of the fan case when viewed from the direction indicated by arrow A shown in FIG. 3.

FIG. 4 is an elevational view of a principal part of the fan case that is included in the electric blower according to the embodiment of the present invention. FIG. 5 is an enlarged view of a principal part of the fan case when viewed from the direction indicated by arrow A shown in FIG. 3.

FIG. 4 is the view of guide part 13*c*, which forms opening part 13, of fan case 2 when viewed from the thrust direction (from the lower side of FIG. 1). FIG. 5 is the view of guide part 13*c* of fan case 2 shown in FIG. 3, when viewed from the direction indicated by arrow A.

In guide part 13*c*, mushroom-shaped anchors 2*b* are disposed at six locations, one for each. The number of mushroom-shaped anchors 2*b* is preferably three to eight. If the number of mushroom-shaped anchors 2*b* is less than three, it results in a reduced strength of holding fan seal 4. Therefore, during the rotation of fan 3, the proof stress of the configuration is insufficient against the stresses caused by the rotation of fan 3. Consequently, there is a risk that fan seal 4 will be dislodged during the rotation of fan 3. Conversely, if the number of mushroom-shaped anchors 2*b* is more than eight, it results in a deteriorated circularity of guide part 13*c*. The thus-deteriorated circularity of guide part 13*c* reduces the circularity of opening part 13 as well. The thus-reduced circularity of opening part 13, in turn, decreases the airtightness between fan 3 and fan seal 4. As a result, the output of the electric blower drops.

Figure 6:
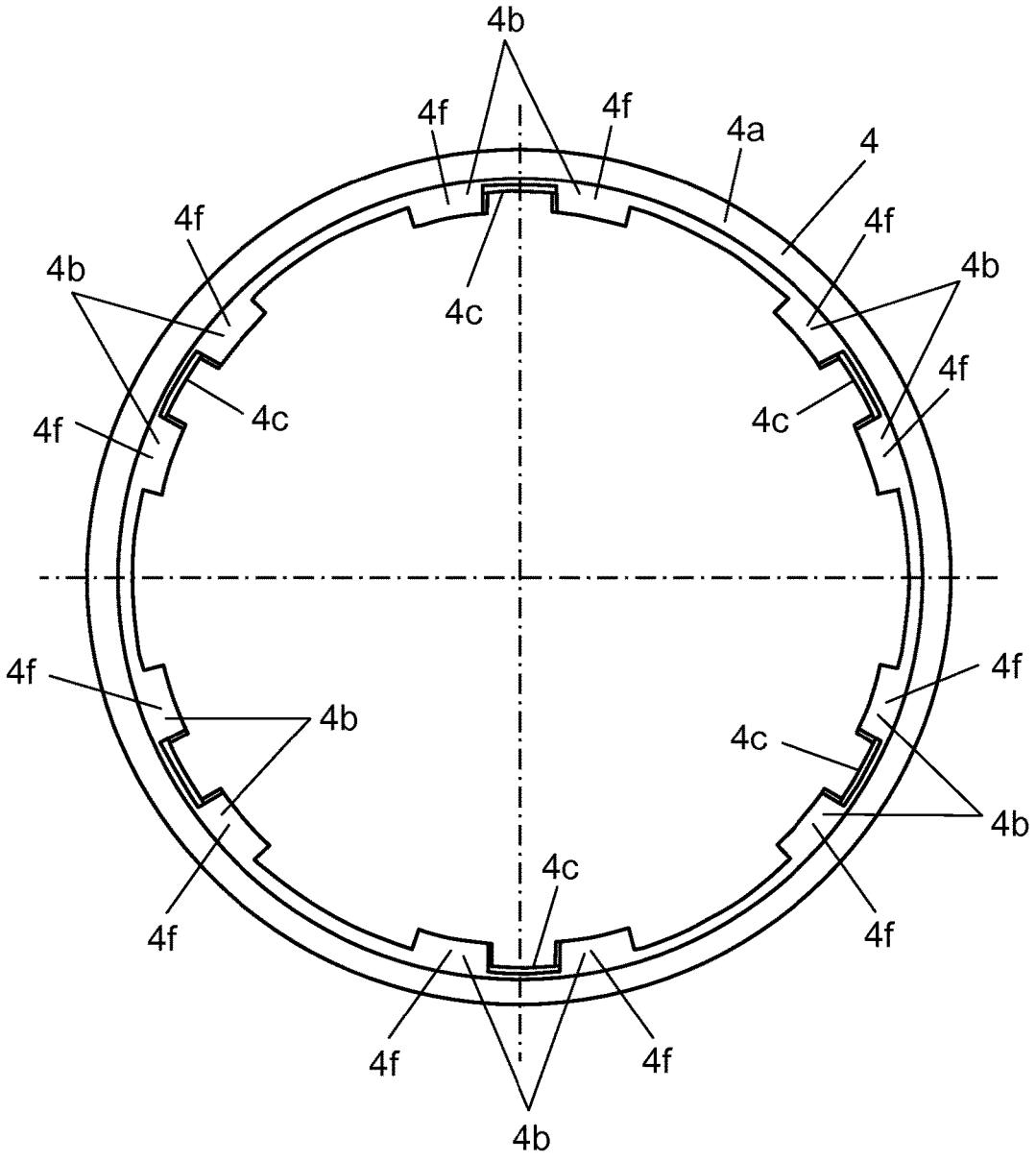
FIG. 6 is an elevational view of a fan seal which the electric blower includes.
Figure 7:
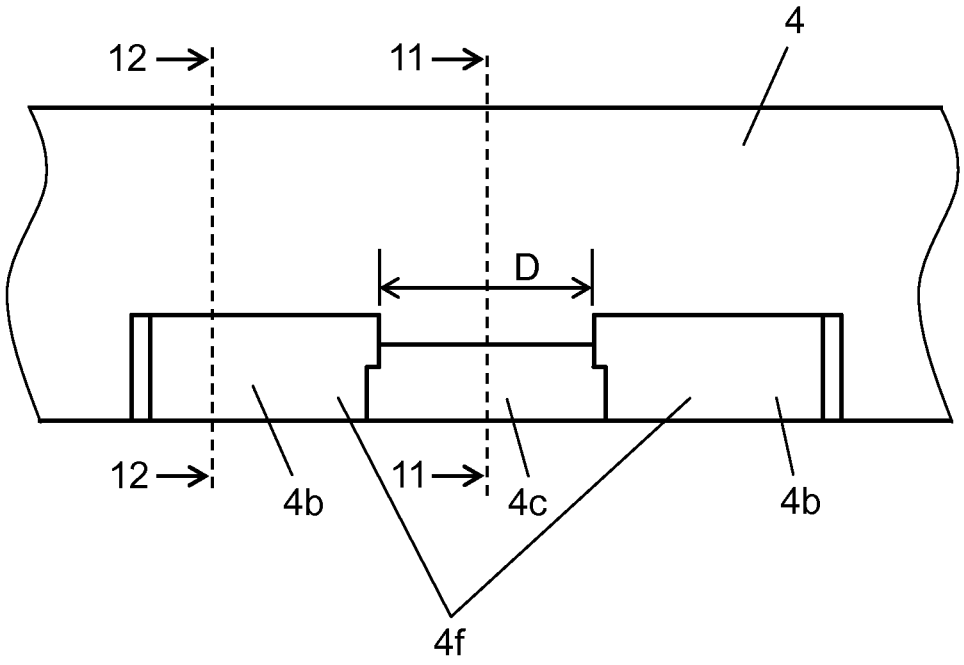
FIG. 7 is an enlarged view of a principal part of the fan seal when viewed from the direction indicated by arrow B shown in FIG. 3.

FIG. 6 is an elevational view of the fan seal that is included in the electric blower according to the embodiment of the present invention. FIG. 7 is an enlarged view of a principal part of the fan seal when viewed from the direction indicated by arrow B shown in FIG. 3.

FIG. 6 is the view of fan seal 4, when viewed from the thrust direction (from the lower side of FIG. 1). FIG. 7 is the view of holding part 4*b* included in fan seal 4 shown in FIG. 3, when viewed from the direction indicated by arrow B.

In fan seal 4, holding parts 4*b* are disposed. Each of holding parts 4*b* includes a pair of bumps 4*f*. The pair of bumps 4*f* is coincident in shape with space parts 2*d* that are located on both sides of each of mushroom-shaped anchors 2*b* shown in FIG. 5. In fan seal 4, holding parts 4*b* are disposed at six locations, one for each. That is, fan seal 4 is provided with six holding parts 4*b*; therefore, a total 12 of bumps 4*f* are disposed.

Here, a specific example will be described concerning the relation between mushroom-shaped anchors 2*b* and holding parts 4*b*.

Distance D between bumps 4*f* of the pair shown in FIG. 7 is about 0.5 mm smaller than width C of fluke part 2*e* of each of mushroom-shaped anchors 2*b* shown in FIG. 5.

Mushroom-shaped anchor 2*b* shown in FIG. 5 has shank part 2*f*, serving as anchor's root portion, width E of which is about 0.5 mm smaller than distance D between bumps 4*f* of the pair shown in FIG. 7.

Here, fluke part 2*e* as referred herein is the projection part that protrudes toward both directions perpendicularly intersecting the direction in which the locking parts extend, in mushroom-shaped anchor 2*b* according to the embodiment of the present invention. Moreover, in the projection part, width C of fluke part 2*e* refers to the width across the projection part in the directions in which the projection part protrudes. In the embodiment of the present invention, width C is 3.5 mm, while distance D is 3.0 mm.

Shank part 2*f* as referred herein is the portion that connects between the body of fan case 2 and the end portion of the locking part which extends from the body, in mushroom-shaped anchor 2*b* according to the embodiment of the present invention. In the embodiment of the present invention, width E is 2.5 mm.

Figure 8:
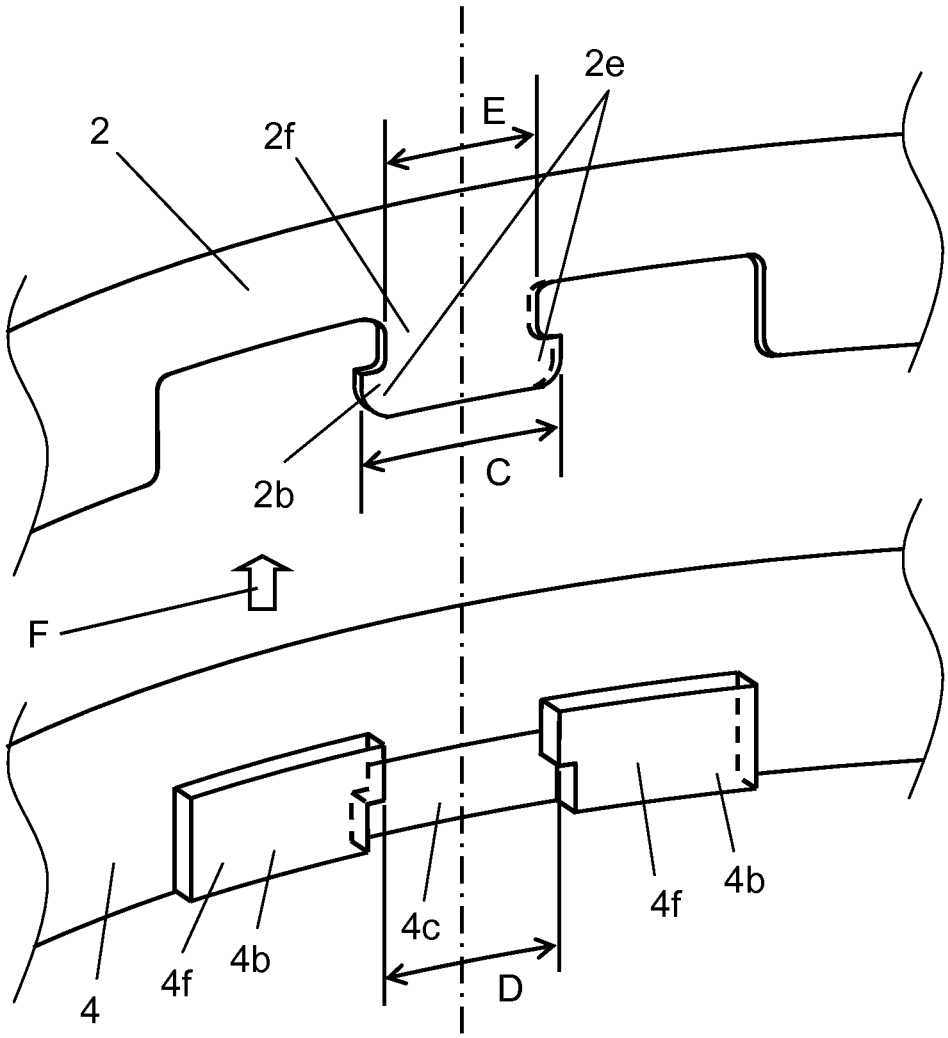
FIG. 8 is a view illustrating steps of assembling the principal parts of the fan case and the fan seal which both are included in the electric blower.
Figure 9:
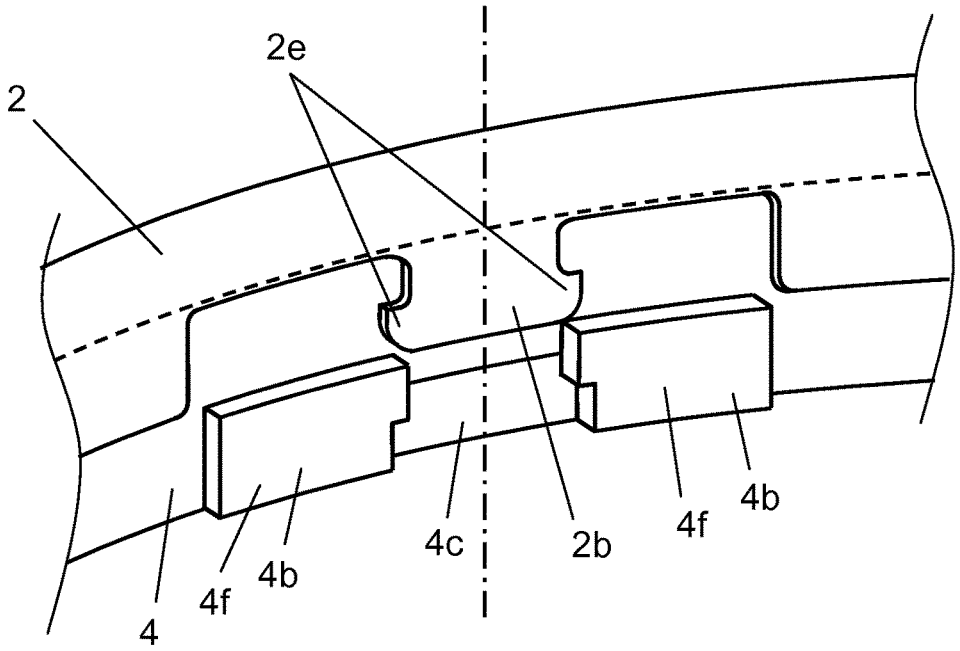
FIG. 9 is a view illustrating the steps of assembling the principal parts of the fan case and the fan seal which both are included in the electric blower.
Figure 10:
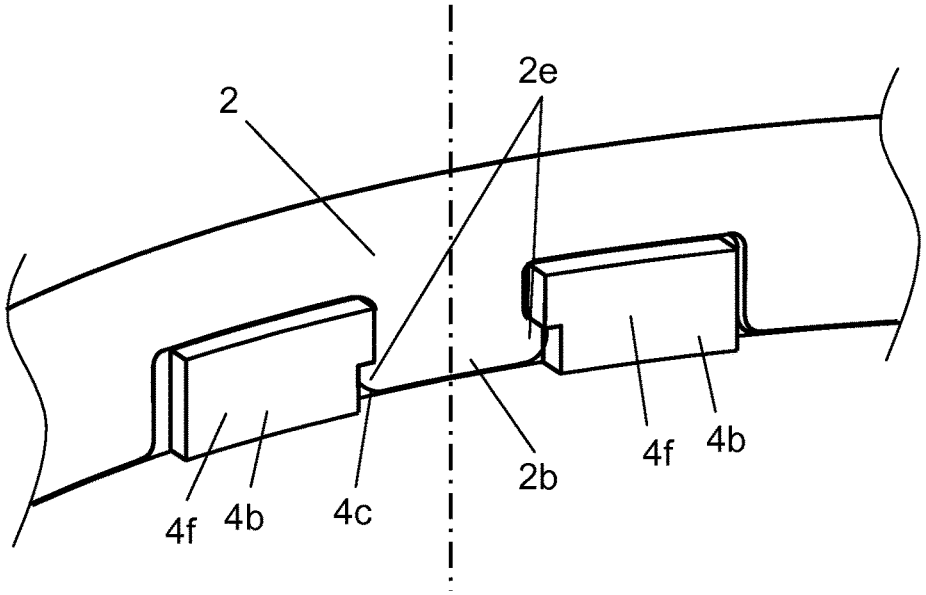
FIG. 10 is a view illustrating the steps of assembling the principal parts of the fan case and the fan seal which both are included in the electric blower.

Fan case 2 and fan seal 4, both having the configurations described above, are combined with each other. Referring to FIGS. 8 to 10, steps of combining fan case 2 and fan seal 4 will be described.

In FIG. 8, fan seal 4 having holding parts 4*b* each of which is formed of the pair of bumps 4*f* is press-fitted onto fan case 2 having mushroom-shaped anchors 2*b*, in the direction indicated by arrow F.

As shown in FIGS. 8 to 9, each of the pairs of bumps 4*f* is press-fitted onto respective one of mushroom-shaped anchors 2*b*. As described above, distance D between bumps 4*f* of the pair is about 0.5 mm smaller than width C across fluke part 2*e* of each of mushroom-shaped anchors 2*b*. With this dimension, the pair of bumps 4*f* is allowed to be press-fitted onto mushroom-shaped anchor 2*b* included in fan case 2.

Moreover, as shown in FIGS. 9 to 10, the pair of bumps 4*f* is press-fitted into recesses beyond fluke part 2*e* of mushroom-shaped anchor 2*b*. As described above, width E of shank part 2*f* is about 0.5 mm smaller than distance D between bumps 4*f* of the pair. With this dimension, shank part 2*f* is allowed to be fitted into bumps 4*f* of the pair; shank part 2*f* is held by bumps 4*f* of the pair.

Thus-fitted fan seal 4 is formed of a material, such as PP (polypropylene) and PET (polyethylene terephthalate), which has a property that it shrinks upon heating. With the material having such a property, the configuration will provide the following effects. That is, upon operation of the electric blower, the temperature of the inside of the electric blower rises. The temperature rise of the inside of the electric blower causes fan seal 4 to shrink due to the heat. When fan seal 4 shrinks due to the heat, it causes fan seal 4 to follow the shape of fan case 2. In other words, inner peripheral surface 4*d* of fan seal 4 coincides in shape with the inner wall surface of fan case 2. Accordingly, this allows more stable dimensional accuracy of both inner peripheral surface 4*d* of fan seal 4 and the inner wall surface of fan case 2.

In addition, the heat shrinkage also provides the effect of increasing the holding strength by holding parts 4*b* that fan seal 4 includes.

As described above with reference to FIGS. 1 to 9, the electric blower according to the embodiment of the present invention includes field magnet 5, armature 7, the pair of brushes 9, fan 3, air guide 1, fan case 2, and fan seal 4.

Field magnet 5 is held by bracket 8. Armature 7 includes the pair of bearings 6 disposed at both ends of armature shaft 21, and is supported by the pair of bearings 6. The pair of brushes 9 is disposed in bracket 8. Fan 3 is disposed on the output side of armature shaft 21. Fan 3 includes suction-side shroud 3*a* and suction port 22 disposed at the center portion of suction-side shroud 3*a*. Air guide 1 is disposed on the exhaust side of fan 3. Fan case 2 covers both fan 3 and air guide 1. Fan case 2 includes opening part 13 at the location facing suction port 22. Fan seal 4 is disposed between inner wall surface 2*a* of fan case 2 and suction port-side end surface 3*b* of suction-side shroud 3*a*. In fan seal 4, inner peripheral surface 4*d* refers to the surface that faces inner wall surface 2*a*. In fan seal 4, outer peripheral surface 4*e* refers to the surface that faces suction port-side end surface 3*b*. Opening part 13 includes the plurality of mushroom-shaped anchors 2*b*. Fan seal 4 includes holding parts 4*b* that fit respectively into mushroom-shaped anchors 2*b*.

In the embodiment, fan seal 4 coincident in shape with fan case 2 is press-fitted onto fan case 2 that includes mushroom-shaped anchors 2*b*. At the same time, holding parts 4*b* that fan seal 4 includes are press-fitted respectively onto mushroom-shaped anchors 2*b* that fan case 2 includes. As a result, mushroom-shaped anchors 2*b* are fitted respectively into holding parts 4*b*. In this way, fan seal 4 is fixed to fan case 2.

Because of the configuration in which fan seal 4 is press-fitted onto fan case 2, in the thrust direction, the holding strength of fan seal 4 by fan case 2 is retained.

Moreover, in the electric blower according to the embodiment of the present invention, opening part 13 includes suction port-side opening end 13*a*, outer-side opening end 13*b*, and guide part 13*c*.

Suction port-side opening end 13*a* communicates with suction port 22. Outer-side opening end 13*b* communicates with the outside of fan case 2. Guide part 13*c* communicates between suction port-side opening end 13*a* and outer-side opening end 13*b*. Guide part 13*c* includes the plurality of mushroom-shaped anchors 2*b* at the periphery of suction port-side opening end 13*a*, in the thrust direction in which guide part 13*c* extends. In the embodiment, the plurality of mushroom-shaped anchors 2*b* are formed, in particular, along the end portion of suction port-side opening end 13*a* that fan case 2 includes.

It is noted, however, that the location where the plurality of mushroom-shaped anchors 2*b* is formed is not limited to the end portion of suction port-side opening end 13*a*. Other locations in the vicinity of suction port-side opening end 13*a* may also be available for the position where the plurality of mushroom-shaped anchors 2*b* is formed, as long as the airtightness between fan case 2 and fan seal 4, to be described later, can be retained.

With this configuration, the following actions and effects can be achieved, in addition to the aforementioned actions and effects.

That is, being formed of an elastic material such as rubber or resin, fan seal 4 can take a profile which fits in shape with opening part 13 of fan case 2.

Specifically, inner peripheral surface 4*d* of fan seal 4 takes the profile that follows the outer periphery of guide part 13*c*, i.e. inner wall surface 2*a* of fan case 2. Outer peripheral surface 4*e* of fan seal 4, i.e. the back side of inner peripheral surface 4*d* of fan seal 4, also takes a profile that follows inner wall surface 2*a* of fan case 2. As a result, the shape of outer peripheral surface 4*e* of fan seal 4 becomes stable. Therefore, the outer peripheral surface becomes in contact with suction port-side end surface 3*b* of suction-side shroud 3*a*. Alternatively, outer peripheral surface 4*e* of fan seal 4, which faces suction port-side end surface 3*b* of suction-side shroud 3*a*, is secured to have a stable dimensional accuracy in terms of concentricity, circularity, and the like.

Moreover, in the electric blower according to the embodiment of the present invention, each of holding parts 4*b* has the following shape. That is, holding part 4*b* is of a bump shape, on inner peripheral surface 4*d*, which is capable of holding respective mushroom-shaped anchor 2*b*. In the embodiment, when fan seal 4 is press-fitted onto fan case 2, bump 4*f* is caused to protrude toward the center of opening part 13.

In particular, the following relation will provide remarkable actions and effects. That is, let t1 be the dimension of protrusion of bumps 4*f* from inner peripheral surface 4*d*, i.e. the thickness of bumps 4*f*, and let t2 be the thickness of the guide part 13*c*. This leads to the relation that t1 is larger than t2.

With this configuration, bumps 4*f* are formed on inner peripheral surface 4*d* of fan seal 4, with the thickness of the bumps being larger than that of fan case 2, especially that of the wall configuring guide part 13*c*. That is, bumps 4*f* are configured such that the end portions of the bumps protrude away from guide part 13*c* in the radial direction, from the inner wall surface 2*a* side to the axial direction side.

Consequently, bumps 4*f* are operative to retain the holding strength of fan seal 4 in the radial direction, when the fan seal is held by fan case 2, especially by guide part 13*c*.

Second Exemplary Embodiment

In addition to the aforementioned first embodiment of the present invention, a second embodiment of the invention will be described which has a configuration that provides exceptionally remarkable actions and effects, with reference to FIGS. 11 to 13.

It is noted, however, that constituent elements the same as those of the first embodiment are designated by the same numerals and symbols. Concerning the constituent elements the same as those of the first embodiment, the descriptions of the first embodiment are incorporated herein by reference.

Figure 11:
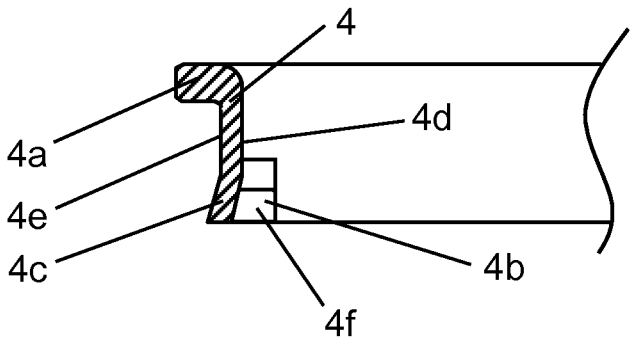
FIG. 11 is a cross-sectional view of a fan seal included in an electric blower according to a second embodiment of the present invention, taken along line 11-11 of FIG. 7.

FIG. 11 is a cross-sectional view of a fan seal included in an electric blower according to the second embodiment of the present invention, taken along line 11-11 of FIG. 7. FIG. 12 is a cross-sectional view of the fan seal included in the electric blower, taken along line 12-12 of FIG. 7. FIG. 13 is a view illustrating the order of steps of assembling principal parts of a fan case and the fan seal which both are included in the electric blower.

Figure 12:
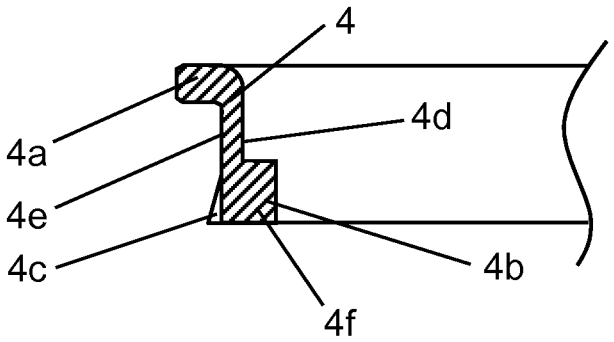
FIG. 12 is a cross-sectional view of the fan seal included in the electric blower, taken along line 12-12 of FIG. 7.
Figure 13:
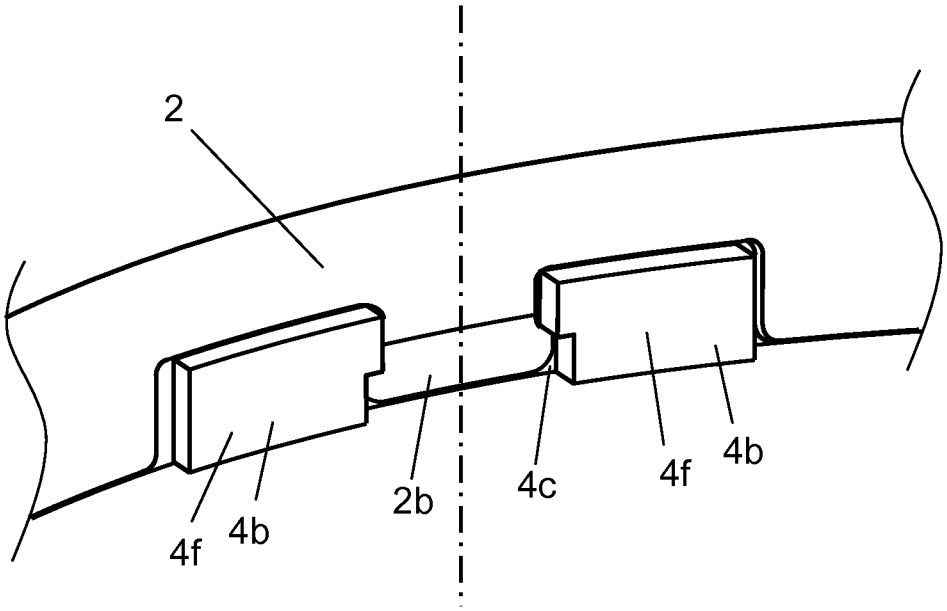
FIG. 13 is a view illustrating steps of assembling principal parts of a fan case and the fan seal which both are included in the electric blower.

As shown in FIGS. 7 and 12, holding parts 4*b* may have the following shape. That is, each of holding parts 4*b* is formed of a pair of bumps 4*f*. As shown in FIG. 11, in between bumps 4*f* of the pair, holding part 4*b* includes inclined parts 4*c*, inner peripheral surface 4*d* of which is inclined from the inner peripheral surface 4*d* side toward the outer peripheral surface 4*e* side.

As described in the first embodiment with reference to FIG. 10, fan seal 4 is press-fitted onto fan case 2. After that, as shown in FIG. 13, mushroom-shaped anchors 2*b* are bent at an angle along the inclined surfaces of inclined parts 4*c* that fan seal 4 includes. That is, mushroom-shaped anchors 2*b* are inclined along inclined parts 4*c*.

With this configuration, the end portion of each of mushroom-shaped anchors 2*b* is bent at the angle along inclined part 4*c*. The end portion of mushroom-shaped anchor 2*b* includes the projection part that protrudes toward both directions perpendicularly intersecting the direction in which mushroom-shaped anchor 2*b* extends from the body of fan case 2. Since this projection part engages with the pair of bumps 4*f*, fan case 2 becomes in a state of being crimped and fixed to fan seal 4.

As a result, inner peripheral surface 4*d* of fan seal 4 takes a profile that follows the outer periphery of guide part 13*c*, i.e. inner wall surface 2*a* of fan case 2, with both inclined parts 4*c* and the end portions of mushroom-shaped anchors 2*b* being as principal parts. Outer peripheral surface 4*e* of fan seal 4, i.e. the back side of inner peripheral surface 4*d* of fan seal 4, also takes a profile that follows inner wall surface 2*a* of fan case 2. As a result, the shape of outer peripheral surface 4*e* of fan seal 4 becomes more stable than that described in the first embodiment. Consequently, outer peripheral surface 4*e* of fan seal 4 either comes in contact with or faces suction port-side end surface 3*b* of suction-side shroud 3*a*, which allows the outer peripheral surface 4*e* to be secured to have a stable dimensional accuracy in terms of concentricity, circularity, and the like.

Accordingly, since fan seal 4 is held by fan case 2, the strength in the radial and thrust directions becomes further improved. In other words, fan seal 4 is crimped and fixed to fan case 2 in both the thrust and radial directions.

As a result, the electric blower according to the second embodiment of the present invention is secured to have the stable airtightness, which allows the increased output of the electric blower.

As can be seen from the above description, the electric blower according to the embodiments of the present invention is such that the inner peripheral surface of its fan seal is press-fitted so as to be directly in contact with the inner wall surface of its fan case. The mushroom-shaped anchors engage with the respective holding parts. Fan case 2 becomes in the state of being crimped and fixed to fan seal 4. Accordingly, since the press-fitted fan seal is fixed to the fan case, the electric blower is secured to have the stable airtightness. Therefore, the output of the electric blower is increased.

In particular, the end portions of the mushroom-shaped anchors that the fan case includes are bent along the inclined parts that fan seal 4 includes. This configuration allows the further increased airtightness.

Moreover, in accordance with the electric blower according to the embodiments of the present invention, the sealing material can be made smaller in size than that of conventional electric blowers. Furthermore, the electric blower according to the embodiments of the invention eliminates the need for the fixation by bonding or welding, which allows the simplified configuration for the fixation. Consequently, the cheap sealing-configuration is allowed for the electric blower according to the embodiments of the present invention.

INDUSTRIAL APPLICABILITY

The electric blower according to the present invention is capable of adopting the cheap sealing-configuration which allows the stable airtightness between the fan and the fan case. The electric blower according to the invention is applicable to electric devices such as electric cleaners and hand dryers.

REFERENCE MARKS IN THE DRAWINGS

1 air guide
2 fan case
2*a* inner wall surface
2*b* mushroom-shaped anchor
2*c* inner-diametrical surface
2*d* space part
2*e* fluke part
2*f* shank part
3 fan
3*a* suction-side shroud
3*b* suction port-side end surface
4 fan seal
4*a* outer-peripheral flat part
4*b* holding part
4*c* inclined part
4*d* inner peripheral surface
4*e* outer peripheral surface
4*f* bump
5 field magnet
6 bearing
7 armature
8 bracket
9 brush
10 commutator
13 opening part
13*a* suction port-side opening end
13*b* outer-side opening end
13*c* guide part
21 armature shaft
22 suction port

The invention claimed is:

1. An electric blower comprising:

a field magnet held by a bracket;

an armature including a pair of bearings at both ends of an armature shaft, and being supported by the pair of the bearings;

a pair of brushes disposed in the bracket;

a fan disposed on an output side of the armature shaft, and including:

a suction-side shroud; and a suction port disposed in a center portion of the suction-side shroud;

an air guide disposed on an exhaust side of the fan;

a fan case covering the fan and the air guide, and including an opening part at a location facing the suction port, wherein air flows in a direction from the opening part to the suction port; and a fan seal disposed between an inner wall surface of the fan case and a suction port-side end surface of the suction-side shroud, and including:

an inner peripheral surface facing the inner wall surface; and an outer peripheral surface facing the suction port-side end surface, wherein the inner peripheral surface, the outer peripheral surface, and the inner wall surface extend in the direction of the airflow from the opening part to the suction port, the opening part includes a plurality of mushroom-shaped anchors, and the fan seal includes a holding part fitting onto the mushroom-shaped anchors in the direction of the airflow from the opening part to the suction port, wherein the opening part includes:

a suction port-side opening end communicating with the suction port;

an outer-side opening end communicating with an outside of the fan case; and a guide part communicating between the suction port-side opening end and the outer-side opening end, wherein the guide part includes the plurality of the mushroom-shaped anchors at a periphery of the suction port-side opening end in a thrust direction in which the guide part extends, wherein the holding part is a bump for supporting the mushroom-shaped anchors on the inner peripheral surface, and wherein t1 is larger than t2, where t1 is a thickness of the bump, equal to a dimension of protrusion of the bump from the inner peripheral surface, and t2 is a thickness of the guide part.

2. An electric blower comprising:

a field magnet held by a bracket;

an armature including a pair of bearings at both ends of an armature shaft, and being supported by the pair of the bearings;

a pair of brushes disposed in the bracket;

a fan disposed on an output side of the armature shaft, and including:

a suction-side shroud; and a suction port disposed in a center portion of the suction-side shroud;

an air guide disposed on an exhaust side of the fan;

a fan case covering the fan and the air guide, and including an opening part at a location facing the suction port, wherein air flows in a direction from the opening part to the suction port; and a fan seal disposed between an inner wall surface of the fan case and a suction port-side end surface of the suction-side shroud, and including:

an inner peripheral surface facing the inner wall surface; and an outer peripheral surface facing the suction port-side end surface, wherein the inner peripheral surface, the outer peripheral surface, and the inner wall surface extend in the direction of the airflow from the opening part to the suction port, the opening part includes a plurality of mushroom-shaped anchors, and the fan seal includes a holding part fitting onto the mushroom-shaped anchors in the direction of the airflow from the opening part to the suction port, wherein the opening part includes:

a suction port-side opening end communicating with the suction port;

an outer-side opening end communicating with an outside of the fan case; and a guide part communicating between the suction port-side opening end and the outer-side opening end, wherein the guide part includes the plurality of the mushroom-shaped anchors at a periphery of the suction port-side opening end in a thrust direction in which the guide part extends, wherein the holding part is a bump for supporting the mushroom-shaped anchors on the inner peripheral surface, and wherein the holding part includes a pair of the bumps, the inner peripheral surface includes an inclined part between the bumps of the pair, the inclined part inclining from an inner peripheral surface side to an outer peripheral surface side, and the mushroom-shaped anchors incline along the inclined part.

3. An electric blower comprising:

a field magnet held by a bracket;

an armature including a pair of bearings at both ends of an armature shaft, and being supported by the pair of the bearings;

a pair of brushes disposed in the bracket;

a fan disposed on an output side of the armature shaft, and including:

a suction-side shroud; and a suction port disposed in a center portion of the suction-side shroud;

an air guide disposed on an exhaust side of the fan;

a fan case covering the fan and the air guide, and including an opening part at a location facing the suction port, wherein air flows in a direction from the opening part to the suction port; and a fan seal disposed between an inner wall surface of the fan case and a suction port-side end surface of the suction-side shroud, and including:

an inner peripheral surface facing the inner wall surface; and an outer peripheral surface facing the suction port-side end surface, wherein the inner peripheral surface, the outer peripheral surface, and the inner wall surface extend in the direction of the airflow from the opening part to the suction port, the opening part includes a plurality of mushroom-shaped anchors, and the fan seal includes a holding part fitting onto the mushroom-shaped anchors in the direction of the airflow from the opening part to the suction port, wherein the holding part is a bump for supporting the mushroom-shaped anchors on the inner peripheral surface, and wherein the holding part includes a pair of the bumps, the inner peripheral surface includes an inclined part between the bumps of the pair, the inclined part inclining from an inner peripheral surface side to an outer peripheral surface side, and the mushroom-shaped anchors incline along the inclined part.

4. An electric blower comprising:

a field magnet held by a bracket;

an armature including a pair of bearings at both ends of an armature shaft, and being supported by the pair of the bearings;

a pair of brushes disposed in the bracket;

a fan disposed on an output side of the armature shaft, and including:

a suction-side shroud; and a suction port disposed in a center portion of the suction-side shroud;

an air guide disposed on an exhaust side of the fan;

a fan case covering the fan and the air guide, and including an opening part at a location facing the suction port; and a fan seal disposed between an inner wall surface of the fan case and a suction port-side end surface of the suction-side shroud, and including:

an inner peripheral surface facing the inner wall surface; and an outer peripheral surface facing the suction port-side end surface, wherein the opening part includes:

a suction port-side opening end communicating with the suction port;

an outer-side opening end communicating with an outside of the fan case; and a guide part communicating between the suction port-side opening end and the outer-side opening end, and the guide part includes a plurality of mushroom-shaped anchors at a periphery of the suction port-side opening end in a thrust direction in which the guide part extends, and the fan seal includes a holding part fitting onto the mushroom shaped anchors, wherein the holding part is a bump for supporting the mushroom-shaped anchors on the inner peripheral surface, wherein t1 is larger than t2, where t1 is a thickness of the bump, equal to a dimension of protrusion of the bump from the inner peripheral surface, and t2 is a thickness of the guide part.

5. An electric blower comprising:

a field magnet held by a bracket;

an armature including a pair of bearings at both ends of an armature shaft, and being supported by the pair of the bearings;

a pair of brushes disposed in the bracket;

a fan disposed on an output side of the armature shaft, and including:

a suction-side shroud; and a suction port disposed in a center portion of the suction-side shroud;

an air guide disposed on an exhaust side of the fan;

a fan case covering the fan and the air guide, and including an opening part at a location facing the suction port; and a fan seal disposed between an inner wall surface of the fan case and a suction port-side end surface of the suction-side shroud, and including:

an inner peripheral surface facing the inner wall surface; and an outer peripheral surface facing the suction port-side end surface, wherein, the opening part includes a plurality of mushroom-shaped anchors, and the fan seal includes a holding part fitting onto the mushroom-shaped anchors, wherein the opening part includes:

a suction port-side opening end communicating with the suction port;

an outer-side opening end communicating with an outside of the fan case; and a guide part communicating between the suction port-side opening end and the outer-side opening end, and the guide part includes the plurality of mushroom-shaped anchors at a periphery of the suction port-side opening end in a thrust direction in which the guide part extends, wherein the holding part is a bump for supporting the mushroom-shaped anchors on the inner peripheral surface, wherein the holding part includes a pair of the bumps, the inner peripheral surface includes an inclined part between the bumps of the pair, the inclined part inclining from an inner peripheral surface side to an outer peripheral surface side, and the mushroom-shaped anchors incline along the inclined part.

6. An electric blower comprising:

a field magnet held by a bracket;

an armature including a pair of bearings at both ends of an armature shaft, and being supported by the pair of the bearings;

a pair of brushes disposed in the bracket;

a fan disposed on an output side of the armature shaft, and including:

a suction-side shroud; and a suction port disposed in a center portion of the suction-side shroud;

an air guide disposed on an exhaust side of the fan;

a fan case covering the fan and the air guide, and including an opening part at a location facing the suction port; and a fan seal disposed between an inner wall surface of the fan case and a suction port-side end surface of the suction-side shroud, and including:

an inner peripheral surface facing the inner wall surface; and an outer peripheral surface facing the suction port-side end surface, wherein the opening part includes a plurality of mushroom-shaped anchors, and the fan seal includes a holding part fitting onto the mushroom-shaped anchors, wherein the holding part is a bump for supporting the mushroom-shaped anchors on the inner peripheral surface, wherein the holding part includes a pair of the bumps, the inner peripheral surface includes an inclined part between the bumps of the pair, the inclined part inclining from an inner peripheral surface side to an outer peripheral surface side, and the mushroom-shaped anchors incline along the inclined part.

7. An electric blower comprising:

a field magnet held by a bracket;

an armature including a pair of bearings at both ends of an armature shaft, and being supported by the pair of the bearings;

a pair of brushes disposed in the bracket;

a fan disposed on an output side of the armature shaft, and including:

a suction-side shroud; and a suction port disposed in a center portion of the suction-side shroud;

an air guide disposed on an exhaust side of the fan;

a fan case covering the fan and the air guide, and including an opening part at a location facing the suction port, and a fan seal disposed between an inner wall surface of the fan case and a suction port-side end surface of the suction-side shroud, and including:

an inner peripheral surface facing the inner wall surface; and an outer peripheral surface facing the suction port-side end surface, wherein the opening part includes a plurality of mushroom-shaped anchors integrally formed with the fan case, and the fan seal includes a holding part fitting onto the mushroom-shaped anchors.

8. The electric blower according to claim 7, wherein each of the plurality of mushroom-shaped anchors protrudes in a thrust direction along an axial direction of the armature shaft.

9. The electric blower according to claim 7, wherein each of the plurality of mushroom-shaped anchors has a mushroom shape in a cross-sectional view along an axial direction of the armature shaft.

10. The electric blower according to claim 7, wherein the opening part includes:

a suction port-side opening end communicating with the suction port;

an outer-side opening end communicating with an outside of the fan case; and a guide part communicating between the suction port-side opening end and the outer-side opening end, and the guide part includes the plurality of the mushroom-shaped anchors at a periphery of the suction port-side opening end in a thrust direction in which the guide part extends.

11. The electric blower according to claim 8 wherein the holding part is a bump for supporting the mushroom-shaped anchors on the inner peripheral surface.

12. The electric blower according to claim 7, wherein the fan seal is press-fitted onto the fan case.

* * * * *